United States Patent [19]

Rachanski et al.

[11] Patent Number: 4,741,229

[45] Date of Patent: May 3, 1988

[54] STUD INSTALLER

[75] Inventors: Michael A. Rachanski; Edward J. Rachanski, Jr., both of Burbank, Ill.

[73] Assignee: EEM Rachanski Enterprises, Inc., Burbank, Ill.

[21] Appl. No.: 14,817

[22] Filed: Feb. 13, 1987

Related U.S. Application Data

[63] Continuation of Ser. No. 770,754, Aug. 29, 1985, abandoned.

[51] Int. Cl.[4] ..... B25B 13/50

[52] U.S. Cl. ..... 81/53.2; 279/7

[58] Field of Search ..... 81/53.2, 55, 125; 279/7

[56] References Cited

U.S. PATENT DOCUMENTS

| | | | |
|---|---|---|---|
| 1,777,628 | 10/1930 | Reedy | 81/53.2 |
| 2,336,157 | 12/1943 | Bayes | 81/53.2 |
| 2,795,159 | 6/1957 | Sipe | 81/53.2 |
| 2,933,960 | 4/1960 | Tann et al. | 81/53.2 |
| 4,106,178 | 8/1978 | Seletyn | 81/53.2 |
| 4,684,138 | 8/1987 | Michaud | 81/53.2 |

FOREIGN PATENT DOCUMENTS

| | | |
|---|---|---|
| 266000 | 1/1968 | Austria . |
| 346351 | 11/1904 | France . |
| 219912 | 8/1924 | United Kingdom . |

OTHER PUBLICATIONS

Popular Mechanics, "A Tool for Driving Studs", vol. 56, No. 3, Sep. 1931, p. 514.

*Primary Examiner*—Frederick R. Schmidt
*Assistant Examiner*—Bradley I. Vaught
*Attorney, Agent, or Firm*—Ronald A. Sandler; Timothy T. Patula

[57] ABSTRACT

A stud insertion and mounting device with a threaded bore formed axially through a tubular body. The bore has an open end and a closed end in which an abutting and locking means is positioned at the closed end to abut the stud for rotatably threading said stud into a suitably tapped receiving hole. A means for releasing the abutting and locking means from the mounted stud is provided, upon which when the device is rotated, the device is unthreaded from the mounted stud. The abutting and locking means may be a cylinder with a chamfered end or other shape. The device may be rotatably driven by a conventional pneumatic source or by hand through a conventional socket or open-ended wrench.

5 Claims, 1 Drawing Sheet

FIG. 2
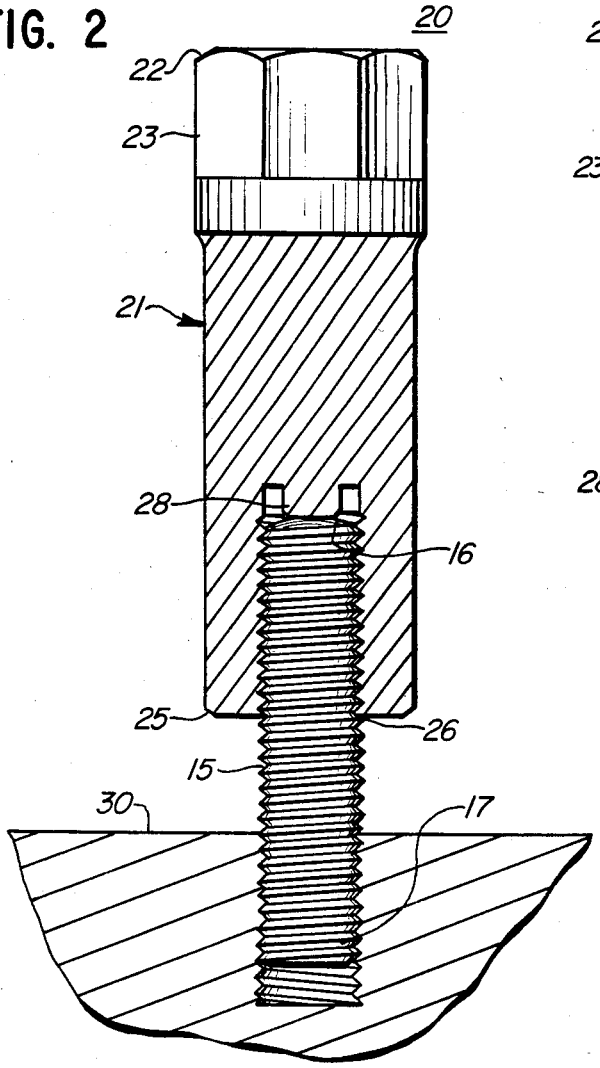
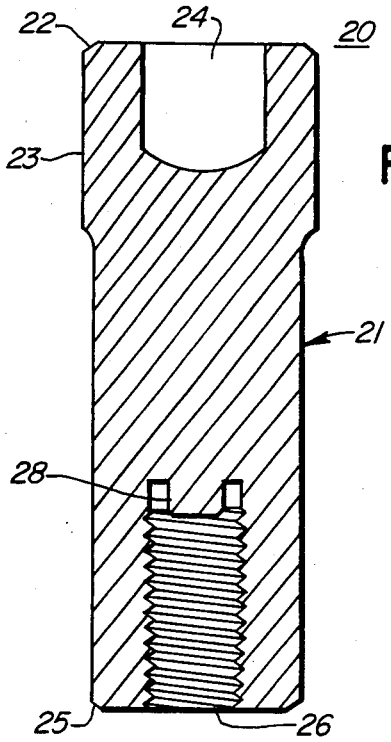
FIG. 3
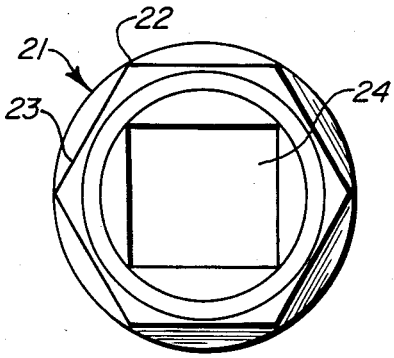
FIG. 4
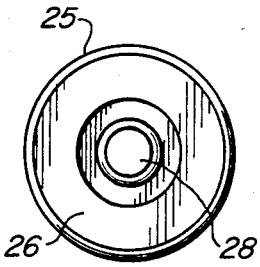
FIG. 5
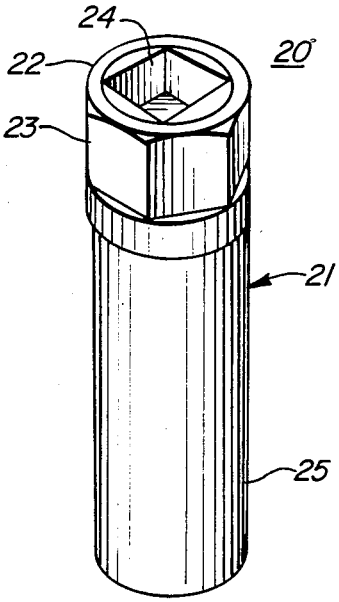
FIG. 1

STUD INSTALLER

This is a continuation of application Ser. No. 770,754, filed on Aug. 29, 1985 now abandoned.

The present invention relates generally to a single component tool for inserting and mounting of headless bolts or studs and the like in mechanical devices.

BACKGROUND OF THE INVENTION

Many engines, transmissions and other mechanical devices use headless bolts or studs for assembly of related components. As used herein, the term "stud" or "headless bolt" refers generally to a shaft having screw threads formed along part or all of its entire length. When assembling components of an engine during production or after repair, studs must be installed without damaging the threads. The insertion of these studs is often a difficult, tedious and very expensive task. One makeshift method commonly used is to "double nut" a stud by threading two nuts onto the stud to be inserted, and tightening each nut against the other in opposite directions until they abut and fixedly lock onto the stud. The assembled double nut and stud combination then is inserted into the required mechanical device using the double nuts as a means for driving the assembled combination. After the stud is mounted, the nuts must be loosened by rotating each in opposite directions and then backed off from the mounted stud. This cumbersome and time consuming method is eliminated by forms of stud insertion tools.

However, in the past many stud driving and insertion tools were complex, either requiring many individual pieces, or were of a design which required considerable amount of effort and physical manipulation in mounting the headless bolt or stud into the associated mechanical device. Many of these tools were very expensive to manufacture because of the large number and intricacy of the individual components.

Accordingly, a principal object of the present invention is to provide a stud insertion device or tool which is of simple construction, efficient in use, and comparatively inexpensive to manufacture.

Previous stud installing tools required use of an independent locking device such as a pin or set screw to first lock the stud into the tool before installation of the stud into the associated member. When these forms of prior devices are utilized, the stud, after being driven and mounted into the desired location, must then be unlocked and the tool backed off from the stud while taking care not to loosen the stud from its mounted location. The present invention is designed to install studs into a device and then, release itself with a minimal amount of additional motion and effort.

The present invention requires no moveable locking component to mount or release the stud from the main socket body of the tool. In accordance with the present invention, a stop and release projection is formed as part of a main socket body at the end of a threaded axially bored hole. Any thread design may be utilized in the axially bored hole. This projection may be configured in many different shapes, but preferably may be an arcuate projection such as formed by a ball bearing, or, as depicted in a preferred embodiment, may be a cylindrically shaped projection with a chamfered end. These projections work equally well on round, flat or sunken end studs so long as the abutting surface area between the projection and the stud is less than the entire surface area of the tool abutting end of the stud. This allows the tool to be easily removed from the stud after mounting in the desired location. Furthermore, the present invention utilizes this projection to provide the main driving force to be directed at the center of the associated stud so that the stud is driven straight and is not bent during mounting into the desired location. The pressure created between the stud and the tool will be firm enough to assist in firmly driving and mounting the stud into the required device, but will not restrict the stud's release from the tool socket thereafter.

Other prior stud-mounting tools utilize locking rings or collars with threaded pitches different than the pitch of the stud. This difference would cause the ring or collar to "jam" onto the stud and thereby, catch and engage the stud. After insertion, the device must be reversed to "un-jam" and remove the device from the mounted stud, and, because of the difference in thread pitch, excessive wear of the stud threads was created.

For example, U.S. Pat. No. 1,438,269 issued to Sehrt, utilizes a sleeve threaded at one end to receive a stud, and the sleeve also is threaded at the other end to receive a cap screw. The cap screw has a greater pitch than the stud. A pin is driven radially through the shaft of the cap screw. Lugs are mounted to the top of the sleeve to enable the sleeve to be rotated when the cap screw is turned to bring the pins into contact with the lugs. Unlike the present invention, Sehrt utilizes a separate sleeve and cap screw to hold and drive the stud.

U.S. Pat. No. 3,292,469 issued to McKean, utilizes a bushing having external multiple threads which are threaded to receive the bushing in a blind hole, and an internal thread to receive the stud. McKean utilizes resilient O-rings to bind and help resist binding upon release of the stud during removal of the stud from the tool once the stud is mounted. The present invention utilizes a totally different means of grasping the stud and locking it into the tool for mounting.

U.S. Pat. No. 2,521,910 issued to Goldberg, utilizes a sleeve with an internally threaded bore formed with three arcuate evenly spaced corroborating die cutting teeth, the same being separated by slots or notches extending the full length of the tool, whereby a headless bolt or screw is threaded by hand into the threaded bore. A pin is radially inserted through selected holes in the sleeve to contact the stud. After the stud is driven, the pin is removed, thus releasing the stud. The present invention is distinct from Goldberg in that it is not a multiple component device with specially cut threads and further does not require a removable pin.

U.S. Pat. No. 2,746,328 issued to Valvano, utilizes a locking pin that is threaded through the cylindrical wall of the tool to lock a jaw set against the stud. The present invention does not utilize pins or jaw sets to lock the stud into the tool before mounting.

The present invention provides many advantages over previous stud installation tools in that it allows for easy insertion of a stud into the tool, then easily mounts the stud into the required device, after which, upon a single action of reverse rotation, allows the mounted stud to be loosened from the tool without appreciably loosening the already mounted stud from the required device, thus allowing the tool to be very quickly backed off from the mounted stud.

An additional advantage is that the present invention is very compact in design, allowing the tool to be used in tight places where many other tools would require greater clearance to operate.

Numerous other advantages and features of the invention will become readily apparent from the following detailed description of the preferred embodiment of the invention, from the claims and from the accompanying drawings in which like numerals are employed to designate like parts throughout.

BRIEF SUMMARY OF THE INVENTION

A headless screw or stud insertion device allows for studs to be mounted with a cylindrically shaped, single component tool whereby the stud is grasped and released without damage to its threads. The stud is locked and held in place by a protrusion extending from the end of an axially threaded endbore. This protrusion may be configured in many different shapes, but preferably may be an arcuate projection or cylindrically shaped projection with a chamfered end. After the stud is driven into the desired mounting location, the tool is rotatably reversed to release the tool from the stud with the projection allowing the mounting stud to be released and backed off without appreciable loosening of the stud mounted in the desired location.

BRIEF DESCRIPTION OF THE DRAWINGS

A fuller understanding of the foregoing may be had by reference to the accompanying drawings, wherein:

FIG. 1 is a perspective view of the stud insertion device of the present invention;

FIG. 2 is a lateral view of the present invention in partial cross-section of the stud insertion tool with a stud engaged within the tool and being partially mounted into an associated mounting device;

FIG. 3 is a lateral view in full cross-section of the stud insertion tool shown in FIG. 1 but with no stud in position;

FIG. 4 is a top plan view of the stud insertion tool showing its female socket driving end; and FIG. 5 is bottom plan view of the stud driving end of the stud insertion tool showing the chamfered cylindrical end projecting from the end of stud insertion hole.

DETAILED DESCRIPTION OF THE INVENTION

While this invention is susceptible of embodiment in many different forms, there is shown in the drawings and will herein be described in detail a preferred embodiment of the invention. The invention disclosed herein is equally applicable to many conventional stud insertion devices besides the embodiment shown and described below. It should be understood, however, that the present disclosure is to be considered as an exemplification of the principles of the invention and is not intended to limit the spirit and scope of the invention and/or claims to the embodiment illustrated.

Referring now to FIGS. 1 and 2, the numeral 20 refers generally to a stud insertion tool constructed in accordance with the present invention. A stud 15 is depicted in FIG. 2, in which stud driving end 16 is engaged and locked into cylindrical stud holder 21, and with the stud mounting end 17 being partially mounted into an associated device 30. The holder 21 having a closed end 22 and an open end 25. The closed end 22 is comprised of an elongated tubular member provided with a driving hexagonally-shaped head 23. The open end 25 is formed to provide an axially threaded internal bore 26. A chamfered end projection 28 projects centrally from the closed end of threaded bore 26 toward open end 25. The protrusion 28 is provided to meet and abut the stud 15 and to releasably lock thereto in a manner described hereinbelow.

FIG. 3 is a cross-sectional side view of the cylindrical stud holder 21 showing first end 22, second end 25, threaded bore 26, head 23, and additionally depicting female drive socket means 24.

FIG. 4 is a top view of cylindrical stud holder 21 showing first end 22, head 23 and female socket means 24.

FIG. 5 is an end view of second end 25 into which a stud 15 (shown in FIG. 2) may be inserted into the threaded bore 26 and abut projection 28.

The operation of the present invention is simply and effectively described as follows. A stud 15 is selected for mounting into a required location such as depicted in FIG. 1 as mounting location 30. Stud 15 is threaded into the second end 25 of cylindrical stud holder 21 via the threaded bore 26. Stud 15 is threaded until stud driving end 16 of stud 15 meets and abuts chamfered end projection 28. Stud 15 is threaded until reaching finger tightness or the required torque level to keep stud 15 frictionally and fixedly held against projection 28. Cylindrical stud holder 21 is thereby driven by means of applying a rotatable force at the first end 22 either via head 23 or female drive socket means 24, to firmly seat stud 15 into mounting location 30 as depicted in FIG. 1.

After cylindrical stud holder 21 has completely mounted stud 15 into the required location 30, holder 21 is rotated in a reverse direction either via hexagonally-shaped head 23 or female drive socket means 24 leaving stud 15 held fixedly in place in the required mounting location 30 while holder 21 releasably unthreads itself from the threaded bore 26 and is no longer in contact with stud 15 at projection 28.

The reverse rotational motion is continued until holder 21 is removed from stud 15 and is no longer in contact with the threaded bore 26.

Cylindrical stud holder 21 allows studs to be mounted in a simple manner by threading and fixedly locking a stud 15 into holder 21 within the threaded bore 26 and abutting against chamfered end projection 28 which is configured in such a way as to hold and frictionally affix stud 15 for driving but readily releases the stud 15 after the stud 15 is mounted in the required location 30 without loosening the mounted stud 15.

The present invention allows studs to be mounted in the above described fashion because of the following principles. The stud is firmly locked and abutted into the tool by the frictional force created between the projection and the tool abutting end of the stud. When the stud is mounted into the desired location by the use of the tool embodying the present invention, the stud mounting end "bottoms out" or frictionally binds itself against the bottom or end of the threaded receiving hole. Whereby, when removing the tool from the mounted stud, by rotating the tool in a reverse direction, a lesser frictional force is required to loosen the stud from the tool than the stud from the receiving hole. The force needed to release the stud from the tool is less because the abutting surface area between the projection and the stud is less than the abutting surface area between the stud and the bottom of the receiving hole. The surface area between the projection and the stud must be less than the entire surface area of the tool abutting end of the stud for the tool to release the mounted stud without loosening the stud from the receiving hole.

While the foregoing has presented certain specific embodiments of the present invention, it is to be understood, that these embodiments have been presented by way of example only. The protrusion extending from the end of the axially threaded stud insertion endbore may be configured in many other shapes than that depicted in the preferred embodiment. A conical as well as angularly cylindrical protrusion may also be utilized. It is expected that others will perceive variations which, while differing from the foregoing, do not depart from the spirit and scope of the invention as herein described and claimed.

What is claimed is:

1. A stud installing tool for fixedly securing a threaded stud into an associated stud receiving member, said tool comprising:

an elongated member having open and closed ends;

an internally threaded bore formed in said member and directed from said open end toward said closed end;

stud locking means for frictionally engaging one end of an associated threaded stud received within said threaded bore;

said stud locking means comprising a member portion fixed at all times within said bore and having a lower generally flat faced portion directed toward the open end of said bore said lower face portion being of lesser abutting surface area than the abutting end of an associated threaded stud; and said member portion being substantially fixed against deformation and axial and rotational movement within said bore and depending thereinto from said closed end thereof and adapted to engage the end of the associated stud so as to prevent the end of the associated stud from engaging the closed end of the bore whereby upon rotation of said tool and the stud relative to the stud receiving member said locking means causes a downward force to be exerted onto the upper center portion of the stud and whereby upon counterrotation said locking means is freely disengaged from the driven stud so that said tool effects no counterrotation of the stud while withdrawing said tool from the installed stud.

2. A device for inserting and mounting a stud, said device being comprised of:

an elongated tube with a first end and a second end;

said first end having a coupling means for driving said device;

said second end having a threaded hole bored auxiliary within said elongated tube at least partially the length of said elongated tube;

a projection extending from the end of said threaded hole to meet and abut said stud, said projection at all times being substantially and fixedly secured therein against deformation and rotation and axial movement; and said projection being of lesser abutting surface area than the abutting end of said stud;

whereby upon counterrotation said projection is freely disengaged from the driven stud so that said device effects no counterrotation of the stud while withdrawing said device from the installed stud.

3. The apparatus as recited in claim 2 wherein said projection is a cylinder with chamfered end.

4. The device in claim 2 wherein said projection is a cylinder with chamfered end.

5. The device in claim 2 wherein further including means for driving said elongated tube by a conventional pneumatic or other rotatably driven power source.

* * * * *

UNITED STATES PATENT AND TRADEMARK OFFICE

CERTIFICATE OF CORRECTION

PATENT NO. : 4,741,229

DATED : May 3, 1988

INVENTOR(S) : Michael A. Rachanski et al.

It is certified that error appears in the above-identified patent and that said Letters Patent is hereby corrected as shown below:

Column 6, line 29, Claim 3, "2" should read -- 1 --.

Column 6, line 30, "projection" should read -- stud locking means --.

Signed and Sealed this

Eleventh Day of April, 1989

*Attest:*

DONALD J. QUIGG

*Attesting Officer*

*Commissioner of Patents and Trademarks*